US010067452B2

(12) United States Patent
Kaminaka

(10) Patent No.: US 10,067,452 B2
(45) Date of Patent: Sep. 4, 2018

(54) IMAGE FORMING APPARATUS CONFIGURED TO FORM AN IMAGE ON CONTINUOUS PAPER WITH A BLANK BETWEEN JOBS

(71) Applicant: KONICA MINOLTA, INC., Chiyoda-ku, Tokyo (JP)

(72) Inventor: Junpei Kaminaka, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/480,953

(22) Filed: Apr. 6, 2017

(65) Prior Publication Data

US 2017/0299993 A1 Oct. 19, 2017

(30) Foreign Application Priority Data

Apr. 19, 2016 (JP) ..... 2016-083367

(51) Int. Cl.
*G03G 15/00* (2006.01)

(52) U.S. Cl.
CPC ..... *G03G 15/50* (2013.01); *G03G 15/5016* (2013.01); *G03G 15/6517* (2013.01)

(58) Field of Classification Search
CPC ..... G03G 15/50; G03G 15/5016; G03G 15/6517; G03G 2215/00455
USPC ..... 399/81, 384
See application file for complete search history.

(56) References Cited

U.S. PATENT DOCUMENTS 7,729,004 B2 * 6/2010 Currans ..... B41F 33/00 101/483
2011/0310151 A1 * 12/2011 Serizawa ..... B41J 11/008 347/14
2015/0314618 A1 11/2015 Ohashi
2017/0052493 A1 * 2/2017 Ikeda ..... G03G 15/5016
2017/0139361 A1 * 5/2017 Nishi ..... G03G 15/5012

FOREIGN PATENT DOCUMENTS

JP 2015-212051 A 11/2015

* cited by examiner

*Primary Examiner* — Sophia S Chen
(74) *Attorney, Agent, or Firm* — Buchanan Ingersoll & Rooney PC

(57) ABSTRACT

An image forming apparatus includes: an image forming unit configured to form an image on contiguous paper; a job selecting unit configured to select a plurality of jobs to be continuously executed, by user operation; an amount-of-blank setting unit configured to set an amount of blank to be inserted between the plurality of jobs selected by the job selecting unit, by user operation; and a control unit configured to cause the image forming unit to form the image such that a blank of the amount of blank set by the amount-of-blank setting unit is inserted between the plurality of jobs.

5 Claims, 8 Drawing Sheets

IMAGE FORMING APPARATUS CONFIGURED TO FORM AN IMAGE ON CONTINUOUS PAPER WITH A BLANK BETWEEN JOBS

The entire disclosure of Japanese Patent Application No. 2016-083367 filed on Apr. 19, 2016 including description, claims, drawings, and abstract are incorporated herein by reference in its entirety.

BACKGROUND OF THE INVENTION

Field of the Invention

The present invention relates to an image forming apparatus.

Description of the Related Art

Conventionally, an electrophotographic image forming apparatus has been known having a configuration including a feeding unit that feeds continuous paper, a winding unit that winds the continuous paper, and an image forming unit that performs image forming on a series of continuous paper conveyed from the feeding unit to the winding unit.

Generally, in such an image forming apparatus, operation of the apparatus is stopped for every one job, and adjustment processing is performed in which toner is expelled in order to replace degraded developer.

However, during the adjustment processing, since the continuous paper is conveyed as blank paper, there is always a blank between jobs. The blank between the jobs through the adjustment processing usually has a length of about 4 to 5 m, and has been wastepaper.

To cope with this, for example, in JP 2015-212051 A, for the purpose of reducing occurrence of wastepaper between the jobs, a configuration has been devised that determines whether to insert a margin (blank) between the jobs in accordance with a mode of a second job subsequent to a first job.

As described above, a large portion becomes wastepaper since the blank between jobs through the adjustment processing is too long; meanwhile, for the continuous paper subjected to image forming, there is a demand to make a certain amount of blank in some cases, for example, a case where the paper is conveyed by a roll-to-roll method in subsequent processing.

However, the configuration in JP 2015-212051 A cannot adjust the amount of blank even when the blank is inserted between jobs.

SUMMARY OF THE INVENTION

The present invention has been made in view of such problems, and an object of the invention is to provide an image forming apparatus capable of reducing occurrence of wastepaper due to a blank between different jobs, and inserting an arbitrary blank.

To achieve the abovementioned object, according to an aspect, an image forming apparatus reflecting one aspect of the present invention comprises an image forming unit configured to form an image on continuous paper; a job selecting unit configured to select a plurality of jobs to be continuously executed, by user operation; an amount-of-blank setting unit configured to set an amount of blank to be inserted between the plurality of jobs selected by the job selecting unit, by user operation; and a control unit configured to cause the image forming unit to form the image such that a blank of the amount of blank set by the amount-of-blank setting unit is inserted between the plurality of jobs.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First, a configuration of an image forming system of the present embodiment will be described.

Figure 1:
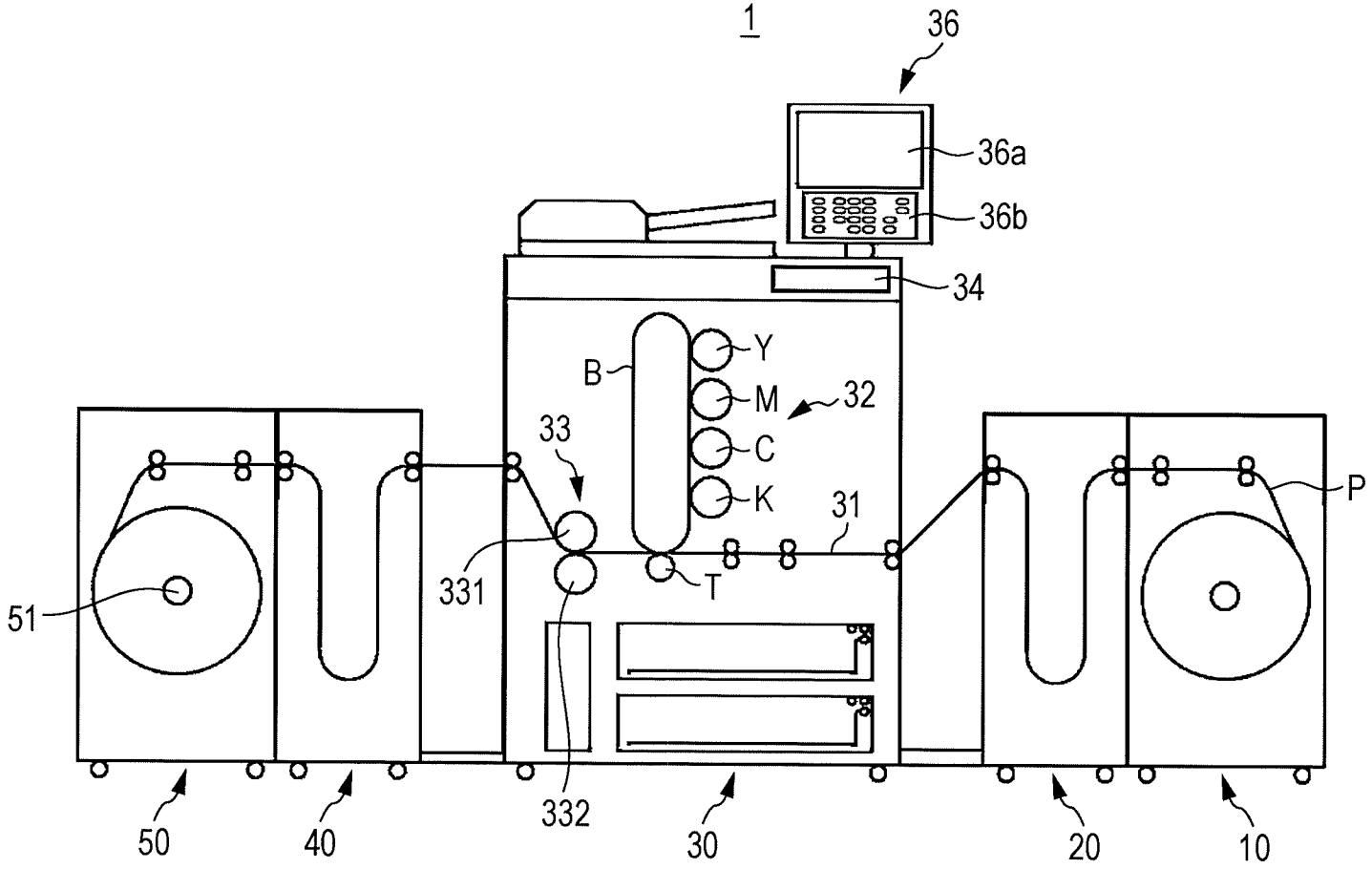
FIG. 1 is a diagram illustrating an example of a schematic configuration of an image forming system of a present embodiment.

FIG. 1 is a diagram illustrating an example of a schematic configuration of an image forming system 1.

As illustrated in FIG. 1, the image forming system 1 is a system that uses continuous paper (roll paper) P as a recording medium and forms an image on the continuous paper P.

As illustrated in FIG. 1, the image forming system 1 is configured by a paper feeding apparatus 10, a paper feeding adjustment apparatus 20, an image forming apparatus 30, a winding adjustment apparatus 40, and a winding apparatus 50 that are connected together from the upstream side along the conveying direction of the continuous paper P.

The paper feeding apparatus 10 is an apparatus for feeding the continuous paper P to the image forming apparatus 30. Within a housing of the paper feeding apparatus 10, the roll-shaped continuous paper P is wound around a support shaft and held to be rotatable, as illustrated in FIG. 1, for example. In the paper feeding apparatus 10, the continuous paper P wound around the support shaft is conveyed to the outside at a constant speed via multiple rollers (for example, a feeding roller and a paper feed roller). Incidentally, in FIG. 1, only one continuous paper P is illustrated; however, a plurality of rolls of continuous paper may be held.

The paper feeding adjustment apparatus 20 is installed at the downstream side of the paper feeding apparatus 10 and the upstream side of the image forming apparatus 30, in the conveying direction of the continuous paper P. The paper feeding adjustment apparatus 20 is an apparatus that conveys the continuous paper P, conveyed from the paper feeding apparatus 10, to the image forming apparatus 30, and causes the continuous paper P to sag down and holds the paper as illustrated in FIG. 1, and adjusts paper feed of the continuous paper P to the image forming apparatus 30, in order to absorb a speed difference between a conveying speed of the continuous paper P in the paper feeding apparatus 10 and a conveying speed of the continuous paper P in the image forming apparatus 30.

The image forming apparatus 30 is an apparatus having a function for forming an image on the continuous paper P. The image forming apparatus 30 is installed at the downstream side of the paper feeding adjustment apparatus 20 and the upstream side of the winding adjustment apparatus 40, in the conveying direction of the continuous paper P.

The winding adjustment apparatus 40 is installed at the downstream side of the image forming apparatus 30 and the upstream side of the winding apparatus 50, in the conveying direction of the continuous paper P. The winding adjustment apparatus 40 is an apparatus that conveys the continuous paper P, conveyed from the image forming apparatus 30, to the winding apparatus 50, and causes the continuous paper P to sag down and holds the paper as illustrated in FIG. 1, and adjusts paper ejection of the continuous paper P from the image forming apparatus 30, in order to absorb a speed difference between the conveying speed of the continuous paper P in the image forming apparatus 30 and a conveying speed of the continuous paper P in the winding apparatus 50.

The winding apparatus 50 is an apparatus that winds the continuous paper P conveyed via the winding adjustment apparatus 40 from the image forming apparatus 30. Within a housing of the winding apparatus 50, the continuous paper P is wound around the support shaft 51 and held in a roll shape, as illustrated in FIG. 1, for example. For that reason, in the winding apparatus 50, the continuous paper P conveyed from the winding adjustment apparatus 40 is wound around the support shaft 51 at a constant speed via multiple rollers (for example, a feeding roller and a paper ejection roller).

Next, a configuration of the image forming apparatus 30 will be described in detail.

Figure 2:
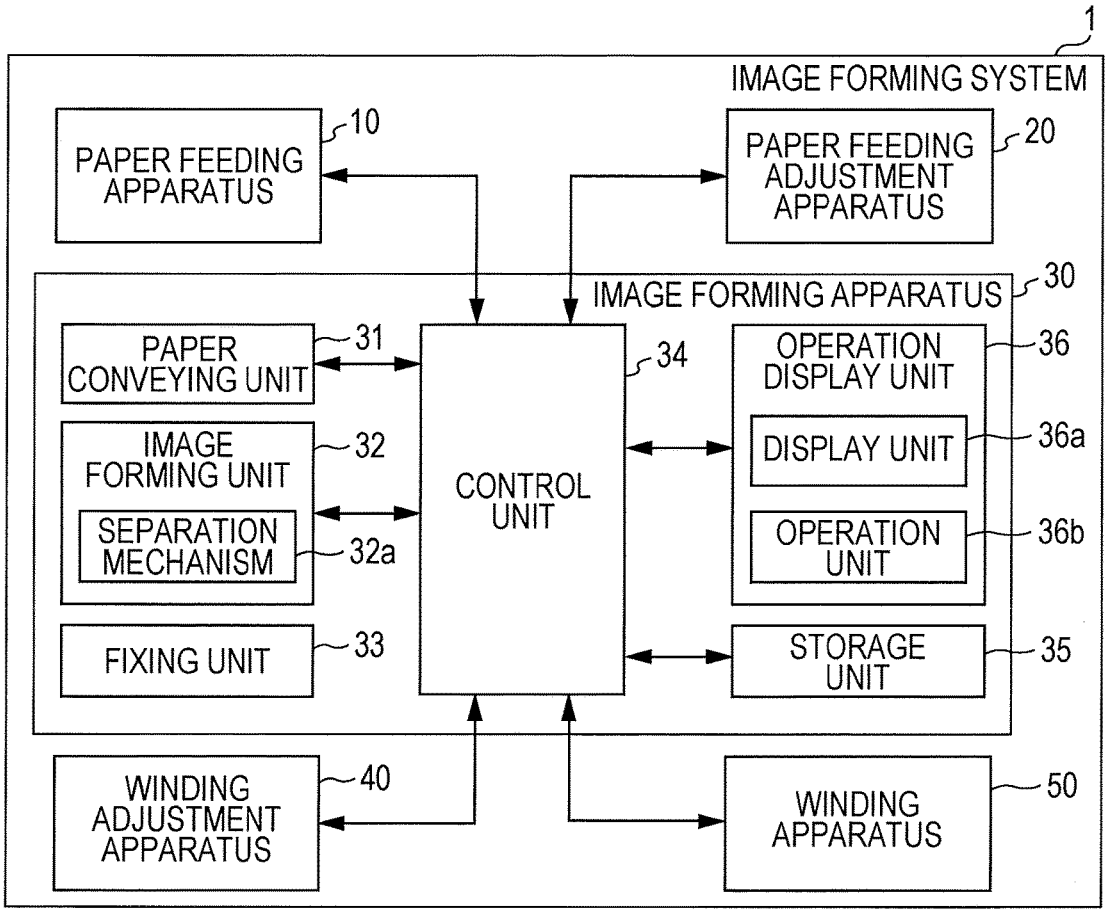
FIG. 2 is a functional block diagram illustrating a control configuration of an image forming apparatus in the present embodiment.

FIG. 2 is a functional block diagram illustrating a control configuration of the image forming apparatus 30.

As illustrated in FIG. 2, the image forming apparatus 30 includes a paper conveying unit 31, an image forming unit 32, a fixing unit 33, an operation display unit 36 as a job selecting unit and an amount-of-blank setting unit, a control unit 34, and a storage unit 35, for example.

The paper conveying unit 31 is a conveying mechanism for the continuous paper P inside the image forming apparatus 30, and conveys the continuous paper P conveyed from the paper feeding adjustment apparatus 20 by multiple rollers to the image forming unit 32, and conveys continuous paper P having passed through the image forming unit 32 and the fixing unit 33 to the winding adjustment apparatus 40, for example.

The image forming unit 32 forms a toner image with an electrophotographic process, and transfers the image to the continuous paper P.

For example, in the image forming unit 32, photoreceptor drums (Y, M, C, K) and an intermediate transfer belt B are used (see FIG. 1). The intermediate transfer belt B is an endless belt, and is wound around multiple rollers and supported to be movable. The color toner images formed on the respective photoreceptor drums (Y, M, C, K) are successively transferred on the intermediate transfer belt B, and a toner image (color image) in which layers of respective colors (Y, M, C, K) are superimposed is formed on the intermediate transfer belt B. Then, a bias with an opposite polarity to the toner is applied to a transfer roller T, whereby the toner image formed on the intermediate transfer belt B is transferred on the continuous paper P.

In addition, the image forming unit 32 includes a separation mechanism 32*a* that separates a nip portion between each of the photoreceptor drums (Y, M, C, K) and the intermediate transfer belt B.

The fixing unit 33 fixes the toner image transferred on the continuous paper P.

For example, the fixing unit 33 includes a pair of rollers consisting of a heating roller 331 and a pressing roller 332, for holding the continuous paper P (see FIG. 1).

The heating roller 331 is heated to a predetermined temperature by a heater as a heating source. The pressing roller 332 is urged toward the heating roller 331 by an elastic member not illustrated. The continuous paper P on which the toner image has been transferred is heated and pressed by passing through a nip portion between the heating roller 331 and the pressing roller 332, and the toner image is fused and fixed.

The control unit 34 is configured by a central processing unit (CPU) and a random access memory (RAM), for example. The CPU of the control unit 34 reads various programs such as a processing program and a system program stored in the storage unit 35, and deploys the programs on the RAM, and then executes various types of processing in accordance with the deployed programs.

For example, the control unit 34 is capable of performing image forming processing that continuously executes a plurality of image forming jobs (hereinafter, referred to as jobs) in accordance with a user's instruction. At this time, the control unit 34 is capable of setting an amount of blank between jobs in accordance with a user's instruction.

In addition, the control unit 34 executes separation operation for the nip portion of the image forming unit 32 between a plurality of jobs by controlling the separation mechanism 32*a* in accordance with the set amount of blank.

Incidentally, the control unit 34 is capable of executing one job alone, of course.

The storage unit 35 is configured by a hard disk drive (HDD) or a nonvolatile semiconductor memory, for example.

The storage unit 35 stores various programs such as a processing program and a system program executed by the control unit 34, and data required for execution of these programs. For example, the storage unit 35 stores setting information required for execution of the image forming processing. The setting information includes an amount of blank between jobs, a continuous image formable distance, and a separation operation distance, for example.

The amount of blank between jobs (hereinafter, referred to as an "amount of blank") is a length of a blank portion inserted between jobs when the plurality of jobs is continuously executed, and is arbitrarily set by the user.

The continuous image formable distance prescribes a length at which there is no problem in image quality even when images are continuously formed.

The separation operation distance is a prescribed length required for executing operation (separation operation) for separating the nip portion in order to prevent a defect such as image quality degradation occurring when the nip portion of the image forming unit 32 (contact portion between the photoreceptor drum and the intermediate transfer belt) is kept in a contact state. During the separation operation, since images are not formed and the continuous paper P is conveyed being blank paper, a predetermined amount (for example, 3 m) of blank is always formed on the continuous paper P when the separation operation is executed.

The operation display unit 36 includes a display unit 36*a* that displays various types of information on a display screen, and an operation unit 36*b* to be used for inputting various instructions by the user.

The operation display unit 36 is used for setting the amount of blank between jobs or selecting jobs to be continuously executed when the plurality of jobs is continuously executed, for example.

Figure 3:
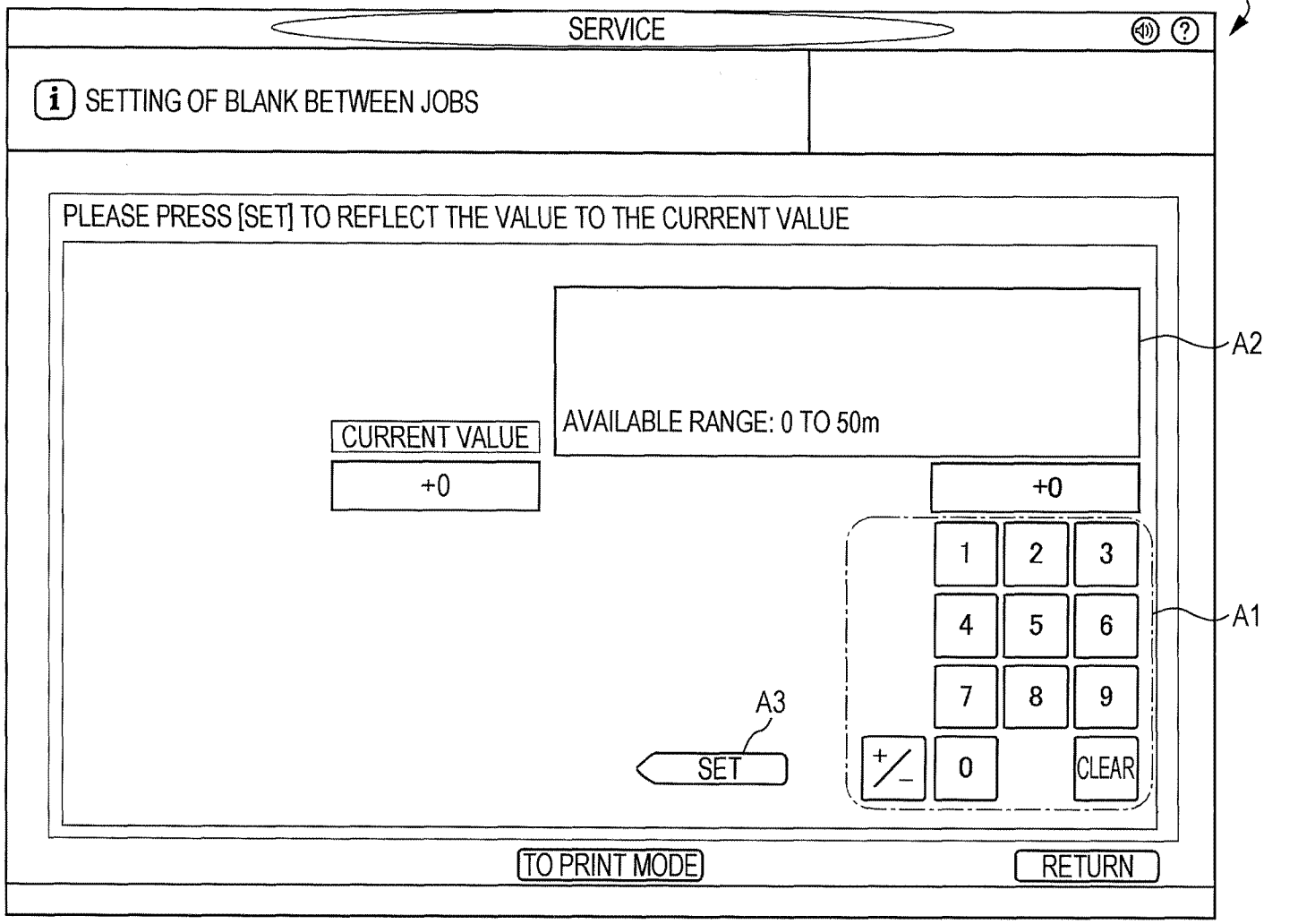
FIG. 3 is a diagram illustrating an example of a setting screen.

FIG. 3 is an example of a setting screen G1 for setting the amount of blank.

As illustrated in FIG. 3, the setting screen G1 includes an operation key group A1, a numerical value display area A2 for displaying an input numerical value, and a confirmation area A3 for confirming (setting) an input content.

When the user operates the operation key group A1 and inputs a numerical value, the input numerical value is displayed in the numerical value display area A2. When the user operates the confirmation area A3 in this state, the numerical value is stored in the storage unit 35 as the setting information of the amount of blank.

Figure 4:
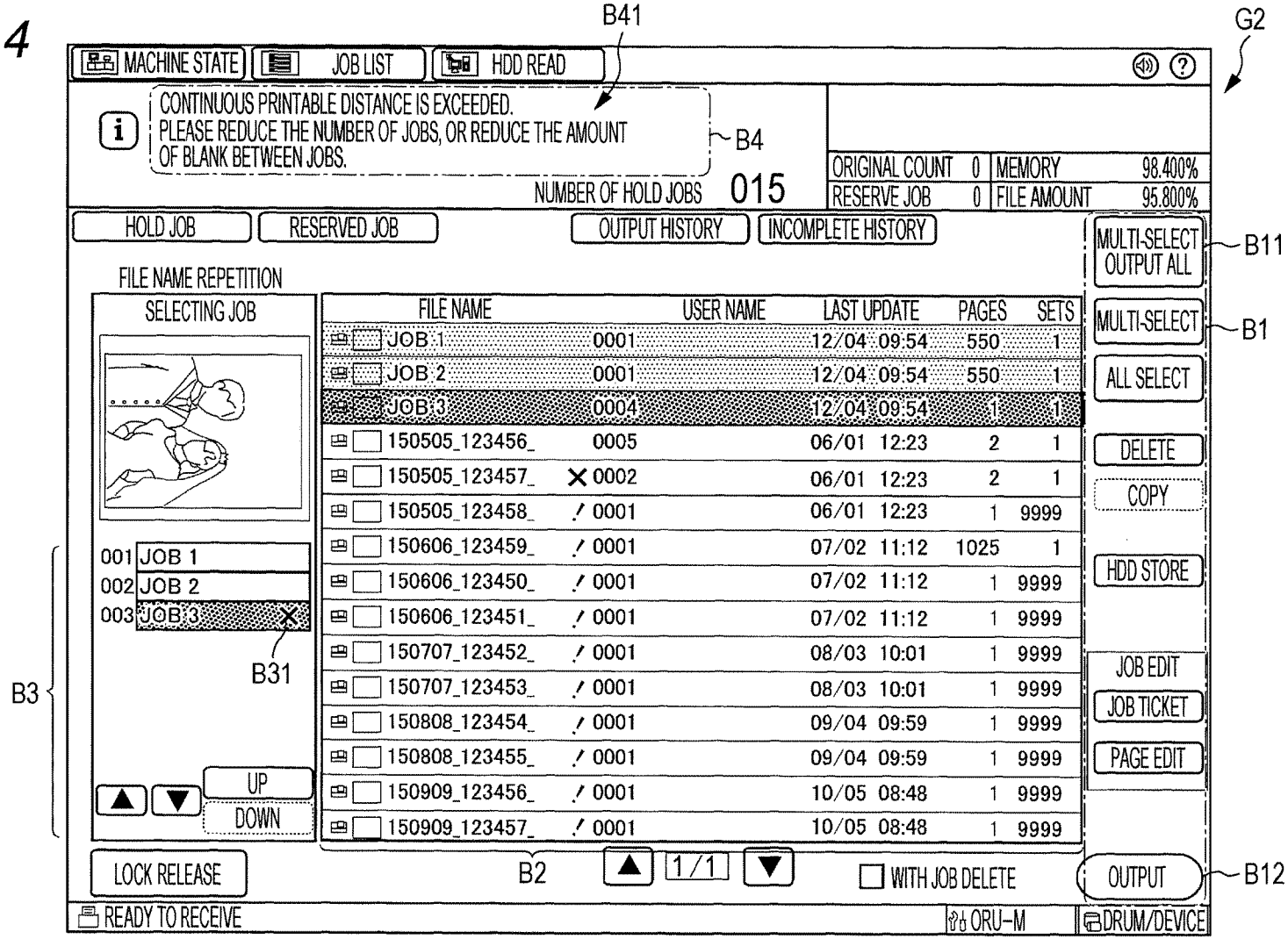
FIG. 4 is a diagram illustrating an example of the setting screen.

FIG. 4 is an example of a setting screen G2 for selecting the plurality of jobs to be continuously executed.

As illustrated in FIG. 4, the setting screen G2 includes an operation button group B1, a first display area B2 for displaying a list of jobs having been input, a second display area B3 for displaying jobs selected in the first display area B2, and a message display area B4 for displaying a message to the user.

The operation button group B1 includes a continuous output button B11 for performing setting of processing for continuously executing the plurality of jobs, and an output instruction button B12 for issuing an output instruction.

In the first display area B2, job information of the input job is displayed in a list in order of input. The job information includes a file name, a user name, a last update date and time, pages, and sets.

In the second display area B3, the file name of the job information selected by the user is displayed in a list, of the job information displayed in a list in the first display area B2.

In addition, in a case where a preset continuous image formable distance is exceeded when the selected jobs are continuously executed, a mark (here, "x") B31 is displayed in the second display area B3 for allowing the user to recognize jobs that cause the exceeding. Incidentally, any kind of the mark B31 may be used.

In addition, in the second display area B3, the file name of the job information is displayed in order of execution from the top, and the order of execution of the jobs can be changed.

In the message display area B4, for example, a message B41 is displayed for prompting the user to perform various types of operation such as setting change.

In the setting screen G2, when the continuous output button B11 of the operation button group B1 is operated by the user, the job information displayed in a list in the first display area B2 can be selected.

When any of the job information displayed in a list in the first display area B2 is selected by the user, the file name of the selected job information is displayed in the second display area B3.

In the example of FIG. 4, in the first display area B2, the three pieces of job information are selected from the top, and their file names (JOB1, JOB2, JOB3) are displayed in the second display area B3.

In addition, in the example of FIG. 4, it is determined that the continuous image formable distance is exceeded in the third job, and the mark B31 is displayed.

Further, in the example of FIG. 4, in the message display area B4, a message B41, "continuous image formable distance is exceeded. Please reduce the number of jobs, or reduce the amount of blank between jobs." is displayed. Incidentally, the content of the message B41 is not limited to this, of course.

When the user performs setting change in view of the mark B31 in the second display area B3 or the message B41 in the message display area B4 (that is, when the number of jobs is reduced, or the amount of blank between jobs is reduced), in accordance with the setting change, the mark B31 in the second display area B3 or the message B41 in the message display area B4 is changed.

When selecting and setting of the plurality of jobs to be continuously executed are ended and the user operates the output instruction button B12 in the operation button group B1, image forming based on the jobs is started.

The operation display unit 36 is used in a case where the user sets handling of the job (such as continuation or cancel of the job) when the job is longer than the continuous image formable distance during individual execution of the jobs, not continuous execution.

Figure 5:
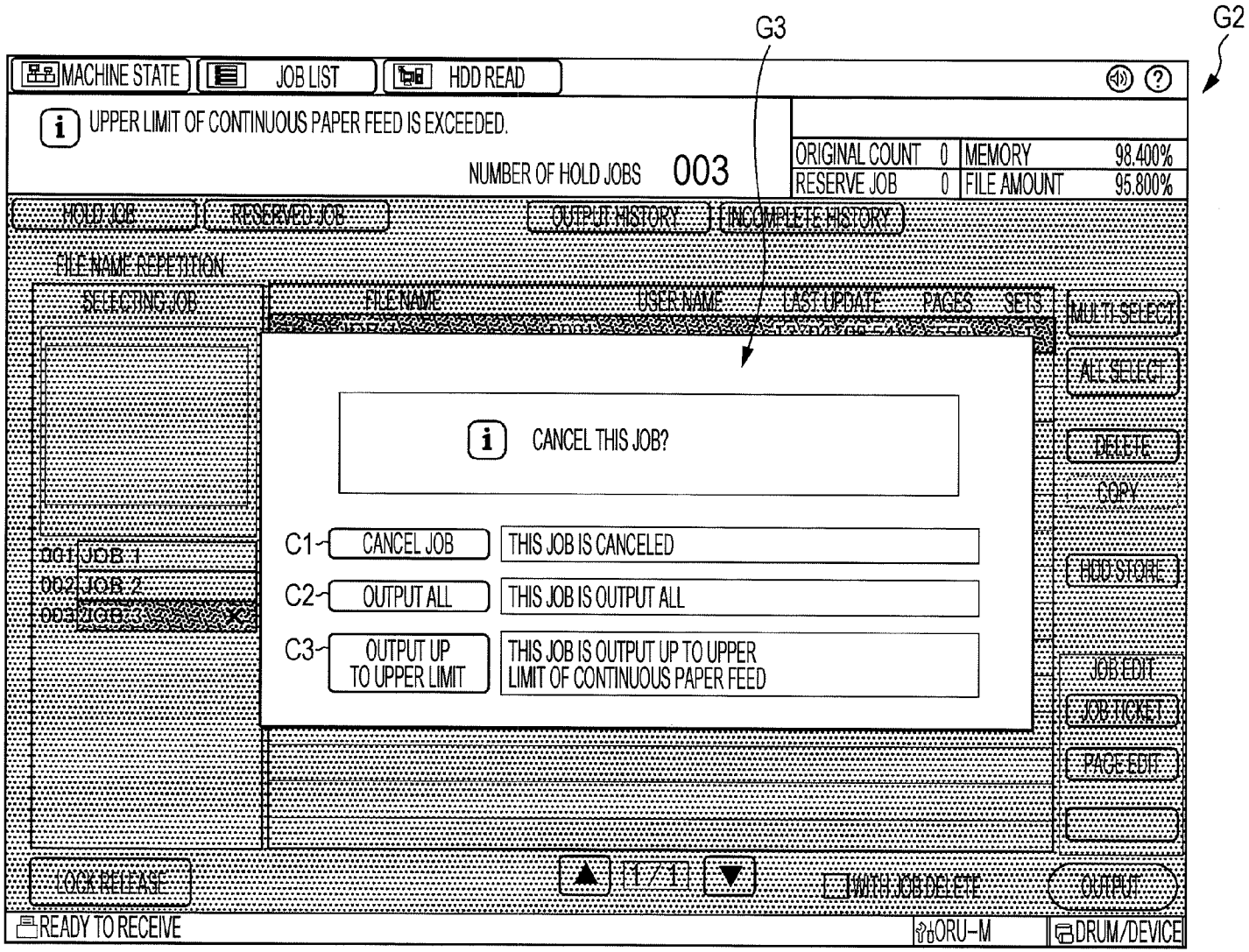
FIG. 5 is a diagram illustrating an example of the setting screen.

FIG. 5 is an example of a setting screen G3 for setting job handling.

The setting screen G3 is a pop-up display displayed on the setting screen G2 in a case where a job is longer than the continuous image formable distance when the job is selected in the setting screen G2 described above and the output instruction button B12 is operated.

As illustrated in FIG. 5, the setting screen G3 includes a cancel instruction button C1, an all output instruction button C2, and an upper limit output instruction button C3.

The cancel instruction button C1 is a button for instructing to cancel the job.

The all output instruction button C2 is a button for instructing to output the entire job even when the continuous image formable distance is exceeded. In this case, the apparatus is stopped when the continuous image formable distance is reached, and adjustment processing is executed for expelling the toner in order to replace degraded developer, and then the rest is output.

The upper limit output instruction button C3 is a button for instructing to output the job up to the continuous image formable distance.

Incidentally, in the present embodiment, the control unit 34 integrally controls the entire image forming system 1 as illustrated in FIG. 2; however, each of the paper feeding apparatus 10, the paper feeding adjustment apparatus 20, the winding adjustment apparatus 40, and the winding apparatus 50 may include a corresponding control unit.

The image forming apparatus 30 may be a multi-function peripheral (MFP) having a copy function, a scan function, and a facsimile function, in addition to an image forming function.

Next, operation will be described of the image forming system 1 in the present embodiment.

Figure 6:
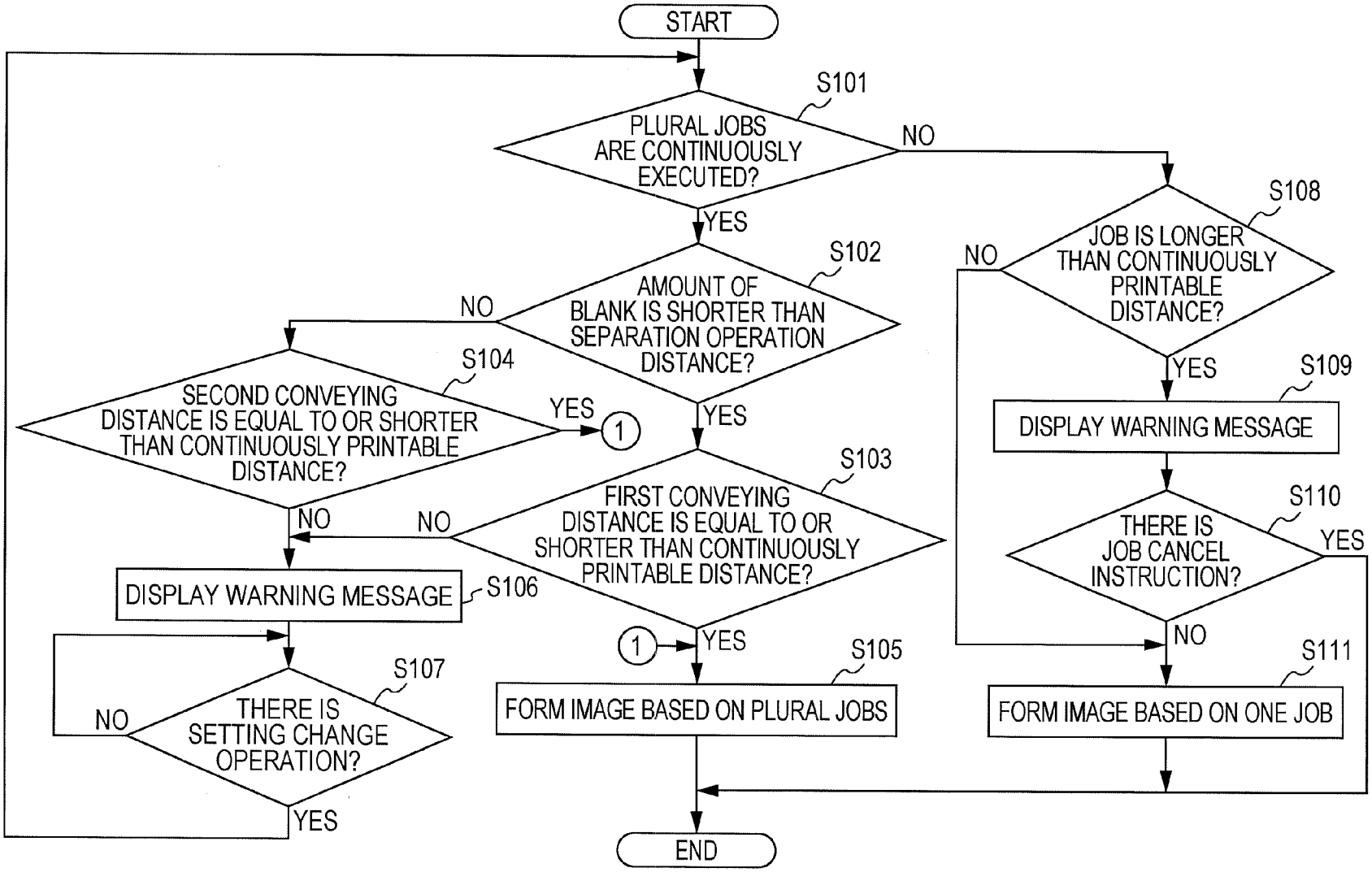
FIG. 6 is a flowchart illustrating image forming processing in the present embodiment.

FIG. 6 is a flowchart illustrating a procedure of the image forming processing.

As a premise of the processing, it is assumed that the user uses the setting screen G1 and arbitrarily sets the amount of blank between the plurality of jobs to be continuously executed, and the set amount of blank is stored in the storage unit 35.

Then, the processing is started triggered by the fact that the user uses the setting screen G2 and starts the setting of the image forming processing.

First, the control unit 34 determines whether the setting has been made for continuously executing the plurality of jobs (step S101).

Specifically, the control unit 34 determines whether the continuous output button B11 in the setting screen G2 has been operated by the user and the job information displayed in a list in the first display area B2 has been selected.

When it is determined that the plurality of jobs is to be continuously executed (step S101: YES), the control unit 34 determines whether the set amount of blank is shorter than a prescribed separation operation distance (step S102).

Step S102 is determination for selecting whether to perform separation operation for the nip portion of the image forming unit 32. That is, the control unit 34 does not execute the separation operation when the amount of blank is shorter than the separation operation distance, and executes the separation operation between the jobs when the amount of blank is equal to or longer than the separation operation distance.

When the amount of blank is shorter than the separation operation distance (step S102: YES), the control unit 34 calculates a distance (first conveying distance) obtained by adding the lengths of all jobs continuously executed and the amount of blank between the jobs together, and determines whether the first conveying distance is equal to or shorter than a prescribed continuous image formable distance (continuously printable distance) (step S103).

Here, regarding step S103, a case will be described as an example in which jobs continuously executed are JOB 1 (length 100 m), JOB 2 (length 100 m), and JOB 3 (length 96 m), and the set amount of blank is 2 m, the prescribed separation operation distance is 3 m, and the prescribed continuous image formable distance is 300 m.

In the example, since the amount of blank is shorter than the separation operation distance, the first conveying distance is 300 m, which is obtained by adding 100 m (JOB 1), 2 m (amount of blank), 100 m (JOB 2), 2 m (amount of blank), and 96 m (JOB 3) together. In addition, in the example, it is determined that the first conveying distance is equal to or shorter than the continuous image formable distance.

On the other hand, when the amount of blank is equal to or longer than the separation operation distance (step S102: NO), the control unit 34 calculates a distance (second conveying distance) obtained by adding the lengths of all jobs continuously executed and the separation operation distance for the number of times of the separation operation to be executed between the jobs together, and determines whether the second conveying distance is equal to or shorter than the prescribed continuous image formable distance (step S104).

That is, when the amount of blank is equal to or longer than the separation operation distance, the conveying distance is calculated by adding the separation operation distance instead of the amount of blank, and comparison with the continuous image formable distance is performed.

Incidentally, when the separation operation distance is used for calculating the second conveying distance, a difference distance obtained by subtracting the separation operation distance from the set amount of blank does not have to be counted for the continuous image formable distance since the continuous paper P is conveyed in a state in which the nip portion of the image forming unit 32 is separated.

Here, regarding step S104, a case will be described as an example in which jobs continuously executed are JOB 1 (length 100 m), JOB 2 (length 100 m), and JOB 3 (length 94 m), and the set amount of blank is 10 m, the prescribed separation operation distance is 3 m, and the prescribed continuous image formable distance is 300 m.

In the example, since the amount of blank is longer than the separation operation distance, the second conveying distance is 300 m, which is obtained by adding 100 m (JOB 1), 3 m (separation operation distance), 100 m (JOB 2), 3 m (separation operation distance), and 94 m (JOB 3) together. In addition, in the example, it is determined that the second conveying distance is equal to or shorter than the continuous image formable distance.

When the first conveying distance is equal to or shorter than the continuous image formable distance (step S103: YES), and when the second conveying distance is equal to or shorter than the continuous image formable distance (step S104: YES), the control unit 34 forms images on the continuous paper P on the basis of the plurality of jobs (step S105), and then ends the processing.

At this time, the control unit 34 continuously forms the images on the basis of the plurality of jobs, and inserts the set amount of blank between the images based on the jobs.

Specifically, when the set amount of blank is shorter than the separation operation distance, the control unit 34 conveys the continuous paper P by the set amount between the jobs, and inserts the set amount of blank. At this time, the nip portion of the image forming unit 32 is kept pressed.

In addition, when the set amount of blank is equal to or longer than the separation operation distance, the control unit 34 controls the separation mechanism 32*a* and executes the separation operation between the jobs. The continuous paper P is conveyed along with the separation operation, and a predetermined amount (for example, 3 m) of blank is formed between the jobs. The control unit 34 performs the separation operation, and then conveys the continuous paper P by the rest of the distance in order to form the set amount of blank, and inserts the set amount of blank between the jobs.

Figure 7A:
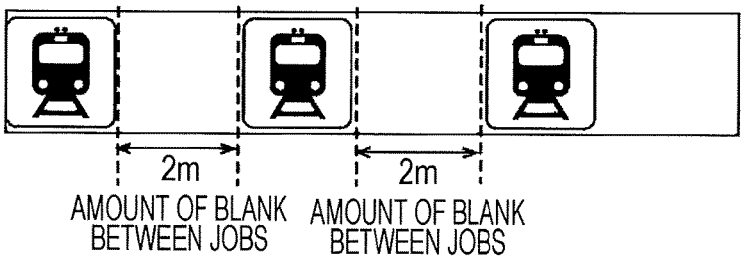
FIGS. 7A to 7C are schematic views each illustrating images output as a result of the image forming processing.

FIG. 7A is a schematic view illustrating an example of images output as a result when the determination is YES in step S102 and YES in step S103.

Figure 7B:
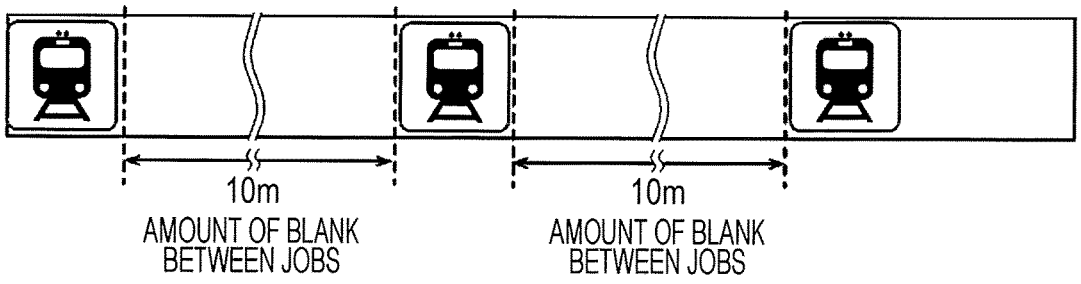

FIG. 7B is a schematic view illustrating an example of images output as a result when the determination is NO in step S102 and YES in step S104.

In FIG. 7A, a blank of 2 m has been inserted between the images based on the jobs.

In FIG. 7B, a blank of 10 m has been inserted between the images based on the jobs.

Incidentally, as described above, in image forming of FIG. 7B, the separation operation is performed, and then the continuous paper P is conveyed by the rest of the distance (7 m), and the set amount (10 m) of blank is inserted between the jobs.

On the other hand, when the first conveying distance is longer than the continuous image formable distance (step S103: NO), and when the second conveying distance is longer than the continuous image formable distance (step S104: NO), the control unit 34 displays a message for warning the user that the job becomes longer than the continuous image formable distance when the selected jobs are executed (step S106).

Specifically, in the setting screen G2 of FIG. 4, the mark B31 is displayed in the second display area B3, and the message B41 is displayed in the message display area B4.

Subsequently, the control unit 34 determines whether there is setting change operation by the user (step S107), and when there is no setting change operation (step S107: NO), repeats the processing of step S107.

On the other hand, when there is setting change operation (step S107: YES), the control unit 34 returns to step S101 described above and repeats the subsequent processing.

In addition, when it is determined that the plurality of jobs is not to be continuously executed in step S101 described above (step S101: NO), that is, when it is determined that one job is to be executed, the control unit 34 determines whether the length of the job is longer than the prescribed continuous image formable distance (step S108).

When the length of the job is equal to or shorter than the continuous image formable distance (step S108: NO), the control unit 34 proceeds to step S111 described below.

On the other hand, when the length of the job is longer than the continuous image formable distance (step S108: YES), the control unit 34 displays a message for warning the user that the length of the job is longer than the continuous image formable distance (step S109).

Specifically, the setting screen G3 of FIG. 5 is displayed as a pop-up display.

Subsequently, the control unit 34 determines whether operation has been made for instructing to cancel the job by the user (step S110).

When the operation has been made for instructing to cancel the job, that is, when the cancel instruction button C1 is operated in the setting screen G3 of FIG. 5 (step S110: YES), the control unit 34 ends the processing.

On the other hand, when the operation has not been made for instructing to cancel the job, that is, when the all output instruction button C2 or the upper limit output instruction button C3 is operated in the setting screen G3 of FIG. 5 (step S110: NO), the control unit 34 proceeds to step S111 described below.

Subsequently, the control unit 34 forms the image on the continuous paper P on the basis of the one job (step S111), and ends the processing.

Here, when the determination is NO in step S108, since the length of the job is equal to or shorter than the continuous image formable distance, the image is formed without having a blank in the middle.

Figure 7C:
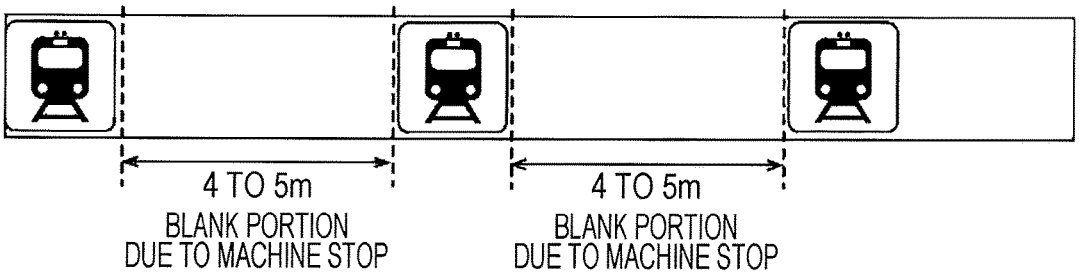

In addition, when the determination is NO in step S110 and the all output instruction button C2 is operated, the apparatus is stopped when the continuous image formable distance is reached, and adjustment processing is performed, and then the rest of the image is formed. The adjustment processing is processing for expelling the toner in order to replace the degraded developer, that is, for drawing a patch drawing on the intermediate transfer belt. Incidentally, in this case, as illustrated in FIG. 7C, the blank inserted due to stop of the apparatus is formed, in the middle of the job.

In addition, when the determination is NO in step S110 and the upper limit output instruction button C3 is operated, the image forming is stopped when the continuous image formable distance is reached.

As described above, according to the present embodiment, the image forming apparatus includes: the image forming unit 32 that forms the image on the continuous paper P; the operation display unit 36 that selects the plurality of jobs to be continuously executed by user operation and sets the amount of blank to be inserted between the plurality of jobs selected, by user operation; and the control unit 34 that causes the image forming unit 32 to form the image such that a blank of the set amount of blank is inserted between the plurality of jobs.

For this reason, the amount of blank between the jobs can be arbitrarily set in the image forming processing on the continuous paper P. Therefore, occurrence of wastepaper due to the blank between different jobs can be reduced, and an appropriate blank can be inserted in consideration of subsequent processing.

In addition, according to the present embodiment, the image forming apparatus includes the separation mechanism 32*a* that performs separation operation for the nip portion of the image forming unit 32, and the control unit 34 controls the separation mechanism 32*a* and executes the separation operation between the plurality of jobs when the amount of blank is equal to or longer than the prescribed separation operation distance required for the separation operation.

For this reason, since the separation operation is executed between the jobs when the amount of blank is equal to or longer than the separation operation distance, progress of degradation of the image forming unit 32 caused by being kept in a contact state of the nip portion is stopped, and a defect such as image quality degradation can be prevented.

In addition, according to the present embodiment, the image forming apparatus includes the display unit 36*a* that displays a predetermined message, and the control unit 34 calculates the first conveying distance obtained by adding the lengths of the plurality of jobs and the amount of blank inserted between the plurality of jobs together when the amount of blank is shorter than the separation operation distance, and displays a warning message on the display unit 36*a* when the first conveying distance is longer than the preset continuous image formable distance.

For this reason, setting change can be prompted of the number of selected jobs, the amount of blank, and the like.

In addition, according to the present embodiment, the image forming apparatus includes the display unit 36*a* that displays a predetermined message, and the control unit 34 calculates the second conveying distance obtained by adding the lengths of the plurality of jobs and the separation operation distance for the number of times of the separation operation to be executed between the plurality of jobs together when the amount of blank is equal to or longer than the separation operation distance, and displays a warning message on the display unit 36*a* when the second conveying distance is longer than the preset continuous image formable distance.

For this reason, setting change can be prompted of the number of selected jobs, the amount of blank, and the like.

(Modification)

Incidentally, when the amount of blank is equal to or longer than the separation operation distance (FIG. 6, step S102: NO), the image forming processing may be configured to confirm whether the length of each job is equal to or longer than the continuous image formable distance and to prompt the change, and to perform the adjustment processing between the jobs.

Figure 8:
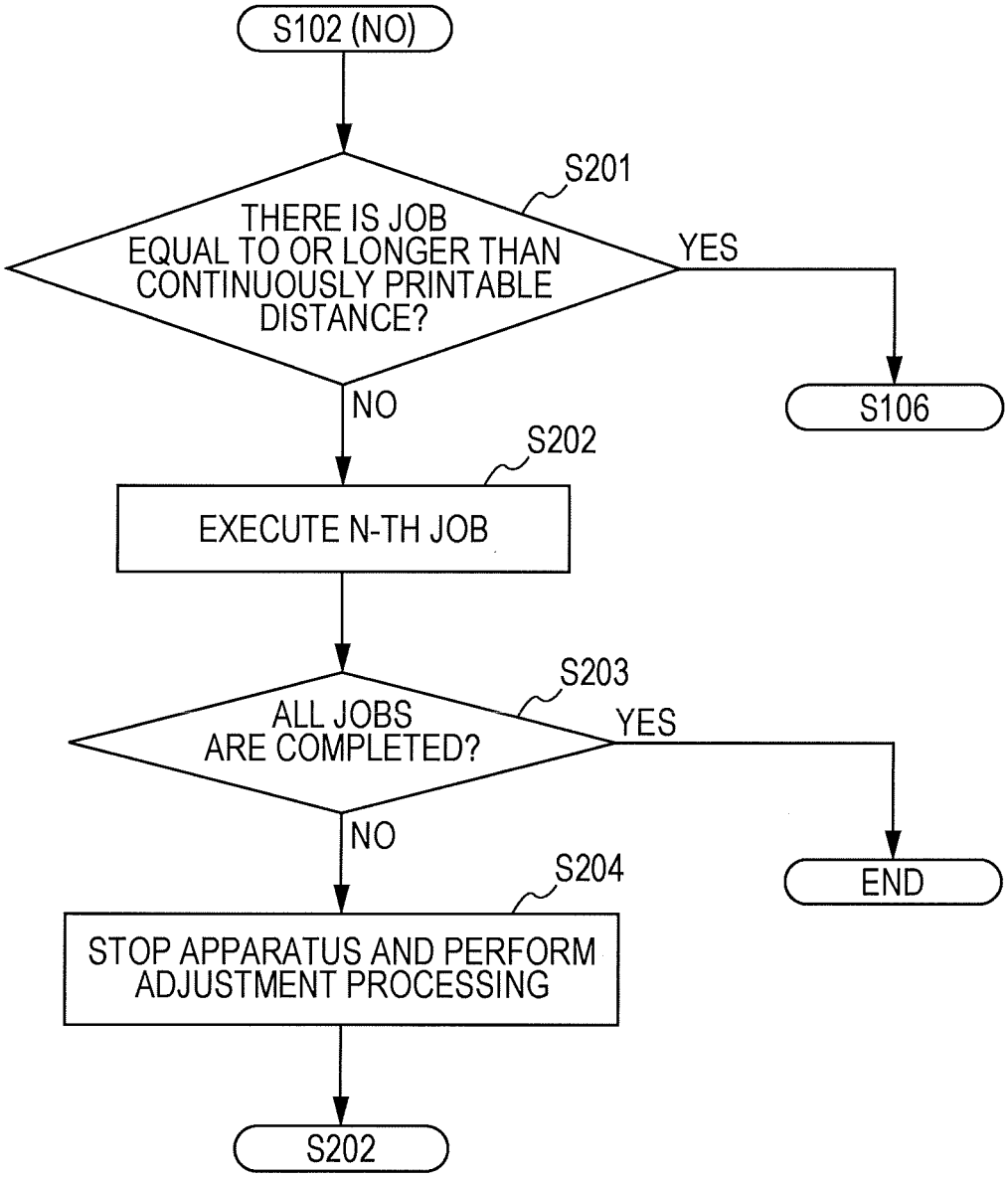
FIG. 8 is a flowchart illustrating a modification of the image forming processing of FIG. 6.

FIG. 8 is a flowchart illustrating image forming processing of this modification.

Since the image forming processing of up to step S102 of FIG. 8 is the same as that of FIG. 6, the subsequent steps will be described.

When the amount of blank is equal to or longer than the separation operation distance (step S102: NO), the control unit 34 determines whether there is a job of which the length is equal to or longer than the continuous image formable distance, among the plurality of jobs (step S201).

When there is the job of which the length is equal to or longer than the continuous image formable distance (step S201: YES), the control unit 34 proceeds to step S106 of FIG. 6.

On the other hand, there is no job of which the length is equal to or longer than the continuous image formable distance (step S201: NO), the control unit 34 performs image forming on the basis of an N-th job of the jobs to be continuously executed (step S202).

Subsequently, the control unit 34 determines whether all the jobs have been executed (step S203), and when all the jobs have been executed (step S203: YES), ends the processing.

On the other hand, when all the jobs have not been executed (step S203: NO), the control unit 34 stops the machine and executes the adjustment processing (step S204), and then returns to step S202 described above, and repeats the subsequent processing.

In step S204, a blank of the set amount of blank is inserted between the jobs.

As described above, according to the modification, when the amount of blank is equal to or longer than the prescribed separation operation distance required for the separation operation, and there is no job equal to or longer than the preset continuous image formable distance among the plurality of jobs, the control unit 34 executes the adjustment operation between the plurality of jobs.

For this reason, when the plurality of jobs is executed, the continuous image formable distance can be reset each time each job is executed.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an image forming unit configured to form an image on continuous paper;

a job selecting unit configured to select a plurality of jobs to be continuously executed, by user operation;

an amount-of-blank setting unit configured to set an amount of blank to be inserted between the plurality of jobs selected by the job selecting unit, by user operation; and a control unit configured to cause the image forming unit to form the image such that a blank of the amount of blank set by the amount-of-blank setting unit is inserted between the plurality of jobs.

2. The image forming apparatus according to claim 1, further comprising a separation mechanism configured to perform separation operation for a nip portion of the image forming unit, wherein the control unit controls the separation mechanism and executes the separation operation between the plurality of jobs when the amount of blank is equal to or longer than a prescribed separation operation distance required for the separation operation.

3. The image forming apparatus according to claim 2, further comprising a display unit configured to display a predetermined message, wherein the control unit calculates a conveying distance obtained by adding lengths of the plurality of jobs and the amount of blank inserted between the plurality of jobs together when the amount of blank is shorter than the separation operation distance, and displays a warning message on the display unit when the conveying distance is longer than a preset continuous image formable distance.

4. The image forming apparatus according to claim 2, further comprising a display unit configured to display a predetermined message, wherein the control unit calculates a second conveying distance obtained by adding lengths of the plurality of jobs and the separation operation distance for the number of times of the separation operation to be executed between the plurality of jobs together when the amount of blank is equal to or longer than the separation operation distance, and displays a warning message on the display unit when the second conveying distance is longer than a preset continuous image formable distance.

5. The image forming apparatus according to claim 1, further comprising a separation mechanism configured to perform separation operation for a nip portion of the image forming unit, wherein the control unit executes adjustment operation for causing the image forming unit to form an image for consuming toner, between the plurality of jobs, when the amount of blank is equal to or longer than a prescribed separation operation distance required for the separation operation and there is no job equal to or longer than a preset continuous image formable distance among the plurality of jobs.

* * * * *